United States Patent [19]

Bartlechner

[11] Patent Number: 4,761,095

[45] Date of Patent: Aug. 2, 1988

[54] PAVING STONE

[75] Inventor: Johann Bartlechner, Kirchweidach, Fed. Rep. of Germany

[73] Assignee: Hans Bartlechner Betonwerke, Kirchweidach, Fed. Rep. of Germany

[21] Appl. No.: 928,411

[22] Filed: Nov. 7, 1986

[30] Foreign Application Priority Data

Nov. 8, 1985 [DE] Fed. Rep. of Germany ... 8531639[U]

[51] Int. Cl.[4] ..... E01C 5/00

[52] U.S. Cl. ..... 404/41; 404/37; 52/590; 52/605

[58] Field of Search ..... 404/34, 37, 38, 39, 404/41, 42; 52/311, 316, 590, 596, 603, 604, 605

[56] References Cited

U.S. PATENT DOCUMENTS

| | | | |
|---|---|---|---|
| 739,345 | 9/1903 | Picha | 52/311 |
| 1,084,058 | 1/1914 | Barbour | 404/38 |
| 1,485,007 | 2/1924 | Zahn | 52/605 |
| 1,699,351 | 1/1929 | Fenberg | 404/39 X |
| 3,464,328 | 9/1969 | Van Der Meijden | 404/41 |
| 4,052,131 | 10/1977 | Lowrigkeit | 404/38 |
| 4,627,764 | 12/1986 | Scheiwiller | 404/41 |

FOREIGN PATENT DOCUMENTS

| | | | |
|---|---|---|---|
| 3926 | of 1926 | Australia | 52/316 |

*Primary Examiner*—Stephen J. Novosad
*Assistant Examiner*—John F. Letchford
*Attorney, Agent, or Firm*—Becker & Becker, Inc.

[57] ABSTRACT

Paving stones of concrete as well as artificial stone material are provided having a tread surface along the top thereof as well as upright sides which are located between corner points of the stone. The side surfaces are provided with serrations, wavy-shaped contours and irregular groove-ridges up to 8 mm deep retreating toward the stone interior along the upright side walls. Such irregular serrations, wavy-shape contours and irregular groove-ridges are adapted to interengage with corresponding configuration of adjoining stones to anchor the stones against any lateral shifting and displacement during travel of a vehicle in a curve or when making a turn as well as during application of brakes of the vehicle wich would result in a horizontal thrust being transmitted to the stones which otherwise would be caused to shift or dislocate from the smooth contour of the tread surfacing of the stones.

12 Claims, 2 Drawing Sheets

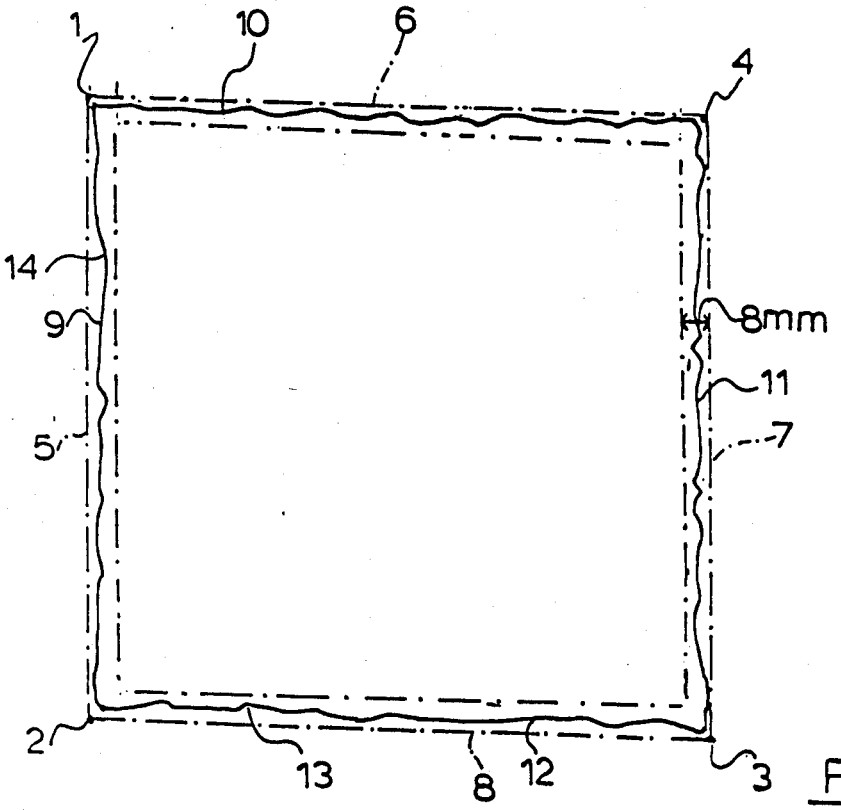
Fig.1
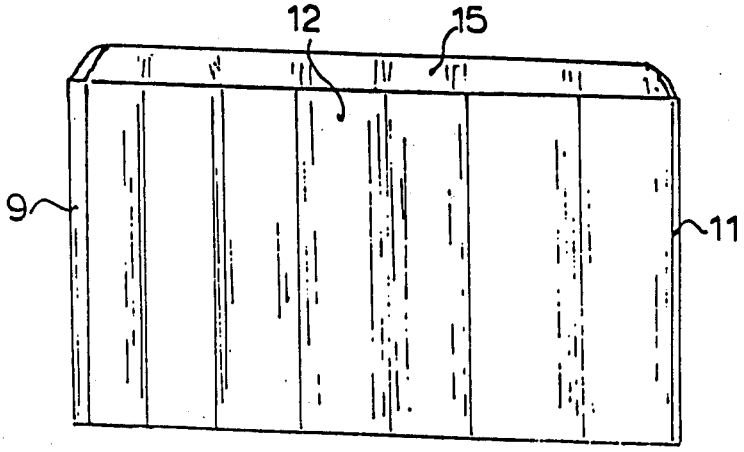
Fig.2
Fig. 2A
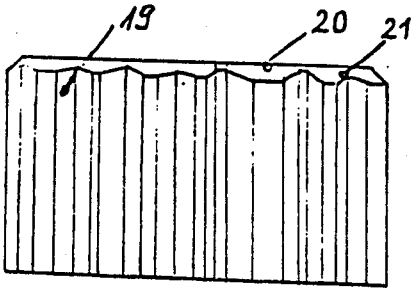

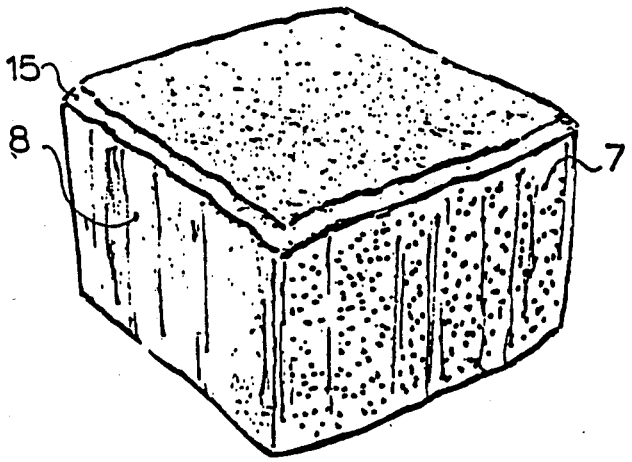
Fig. 3
Fig. 3A
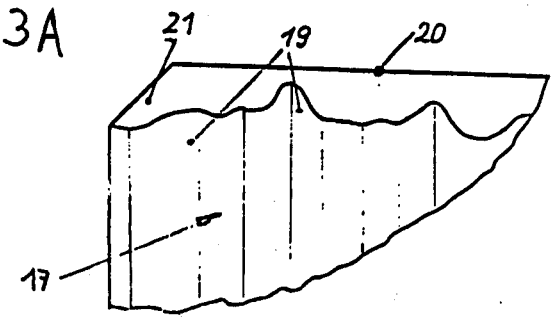
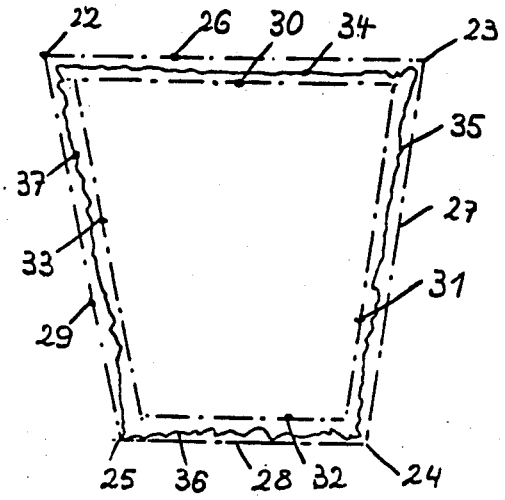
Fig. 4

PAVING STONE

BACKGROUND OF THE INVENTION

1. Field of the Invention

The present invention relates to paving stones of concrete or artificial stone for courtyard surfaces, pedestrian zones, garden layouts, horticultural grounds or the like, which have equal level and which have upright side walls as well as in essence quadratic, rectangular or trapezoidal-shaped area or base surfaces determined by a fixed module in the side dimensions thereof and which can be composed or placed together into patterns during placement thereof. Such patterns can be circular or sectors forming a circle. However, also other patterns closed in themselves in an irregular distribution of the individual types of stones can be placed, set or positioned.

2. Description of the Prior Art

The regularity of such stones produced in an industrial method or procedure results however in a monotony of the pavement composed thereof, which is not compatible with requirements set or encountered therewith for garden plots and park layouts, pedestrian zones and courtyard surfaces of residential installations. On the other hand, such a pavement must have a sufficient or adequate strength, stability or resistance against horizontal moveability or displaceability in order to avoid destruction, disintegration or failure via a horizontal thrust exerted by vehicles that are turning or being braked thereon.

In order to attain this, there are offered paving stones angularly toothed or cornered among each other which are adequate moreover as to the latter technical requirements, but offering an unsatisfactory aspect or appearance particularly just because of the regularity of the teeth, notching or dovetailing thereof.

In order to take into account the requirements as to structural shape, formation, appearance and architecturally, there were developed paving stones with which the contours of the vertical or upright side walls represent circular arches or arcs in a circle flat in horizontal section and the corners are rounded-off between the side walls. Together with the likewise rounded-off corners of the surface driven upon respectively walked upon there is to be aroused with such rounded-off corners the impression of an old worn-away natural stone (arch) pavement subjected to wearing out by driving thereon to appear like hand-hewn masonry stones. Aside therefrom, that also herewith a monotonous impression of identical shapes or forms repeating themselves is awakened, inspired or aroused, there must be noted that this configuration, construction or formation decided upon because of the aesthetic effect thereof also is technically disadvantageous, since the circular arc surfaces of the side walls engage themselves only linearly respectively and the rounded-off corners do not have any possibility of engagement or interlock with the adjoining stones. At the location of meeting or coming together of such rounded-off corners there results a comparatively large hollow space respectively during placement, setting or positioning thereof and this hollow space reduces the stability or strength of the pavement. Such stones accordingly can shift not only against each other but rather also can twist or turn themselves easily, whereby the rounded-off corners roll-off along the adjoining stones.

To be sure, this disadvantage is extensively reduced via flattening of these circular-arc surfaces of the side walls, even if also the round corners are left remaining, whereby a still stronger monotony of the set or positioned pavement surface results.

The irregularity of such stones produced in industrial procedure however does result in a monotony in the pavement composed of such stones which monotony of the pavement is not compatible with pedestrian zones provided in garden layouts and park grounds as well as courtyard surfacing of residential areas for which requirements must be met. On the other hand, such a pavement must have an adequate strength and rigidity against horizontal shiftability in order to avoid destruction via vehicles that are turning and or applying brakes in such a manner to exert a horizontal shift or thrust. In an attempt to attain this strength and rigidity there can be noted that square toothed pavement stones are offered which may approach a solution to the foregoing problems but additionally have an unsatisfactory appearance particularly because of the regularity of the toothed means thereof.

There are also pavement stones known with which the contours of the upright or vertical sidewalls in a horizontal section represent flat circular arcs and the corners between these sidewalls are rounded-off in order to try to meet the requirements from a structural and architectural standpoint. Together with the edges likewise rounded-off as to the top surface of the pavement stones used as a walkway respectively having a tread surface upon vehicles also can move, there is to be awakened or brought about therewith an impression of an old worn-off natural stone pavement consisting of hand-hewn stones. Aside therefrom that also a monotonous impression is awakened herewith due to repetitious identical shapes or forms, there can be noted that such configuration undertaken for the aesthetic effect thereof must be considered to be technically disadvantageous since the circular-arc surfaces of the sidewalls respectively engage each other only linearly and the rounded-off corners have absolutely no engagement possibility with the adjoining or neighboring stones. At the location of the meeting of such rounded-off corners there results a comparatively large hollow space or opening during placement and positioning of the respectively of the stones relative to each other and this hollow space or opening reduces the strength and rigidity of the pavement. Such stones consequently can shift not only with respect to each other but also can be turned or twisted easily whereby the rounded-off corners roll-off along the neighboring or adjoining stones.

By flattening of these circular-arc surfaces of the sidewalls there can be brought about reduction of this advantage even if also the round corners remain therewith, whereby a still stronger monotony results in the positioned pavement stone.

An object of the present invention with the stones of the initially mentioned type is to bring about a gap-free fitting of the stones in a union, assemblage, association or formation and to attain a prevention of slipping-off as to each other, shifting or twisting and turning during a horizontal thrust, without these stones in the formation appearing unattractive and monotonous.

BRIEF DESCRIPTION OF THE DRAWINGS

These objects, and other objects and advantages of the present invention will appear more clearly from the following specification in conjunction with the drawings.

FIG. 1 is a top plan view of the present inventive stone;

FIG. 2 is a side view of the same stone of FIG. 1;

FIG. 2A is a more detailed side view similar to that of FIG. 2;

FIG. 3 is a perspective view showing an illustration of the features of the present inventive stone;

FIG. 3A is a fragmentary enlarged perspective view showing more of the detail of FIG. 2A; and FIG. 4 is a plan view of another embodiment of the pavement stone having features in accordance with the present invention.

SUMMARY OF THE INVENTION

The initially described stones are determined and established in the base measurements or dimensions thereof in horizontal section by the corners of a rectangular surface, whereby the upright or vertical side walls thereof retreat, recede or fall back in irregular zig-zag and/or wavy-shaped contours as far as to 8 mm depth in the vertical or upright to the stone interior from the straight lines drawn between these corners in a quadratic, rectangular or trapezoidal configuration.

DESCRIPTION OF PREFERRED EMBODIMENTS

Referring now to the drawing in detail, the stone illustrated in a horizontal section in FIG. 1 is determined in the shape or form thereof by the corner points 1, 2, 3, 4 and the imaginary lines 5, 6, 7, 8 drawn between these corner points. This basic or fundamental shape determined thereby results in the measurement or dimension for the placement and positioning of the stones in the union, assemblage, association and formation. The shapes or contours of the side walls 9, 10, 11, 12 of the stone themselves retreat, recede or fall back from the imaginary lines 5, 6, 7, 8 up to 8 mm in a direction toward the stone interior in a random or nonselective sequence of flat-angular-cornered or wavy-shaped irregularities 13, 14. These contours of the side walls are equal over all stone cross sections in the upright or vertical direction.

It is expediently useful but not necessary that the intersecting lines of the side walls 9, 10, 11, 12 among each other lie in the corner points 1, 2, 3, 4. These intersecting lines, which actually are to be corners of the stone lie however directly in the vicinity of these corners, although within the surface determined by the corner points 1, 2, 3, 4. A chamfer or bevel-edge 15 is illustrated in FIGS. 1 and 2 with which the walkway or tread surface of the stone has a transition into the side walls, which accordingly follows the irregularities 13 and 14 of the side walls.

FIGS. 2A and 3A show greater detail of a chamfer or bevel 21 at substantially 45° between a walkway or tread surface 20 and the side surface 17, in which the groove, flutes, serrations or scores 19 extend and give to the chamfer or bevel 21 a more irregular and more variable form and shape because these irregular grooves, flutes or serrations 19 extend into the region of the bevel or chamfer 21. FIG. 3A is enlarged perspective view of a portion of the bevel or chamfer 21 as well as the side surface 17 having the grooves, flutes, serrations or scores 19 extend to the chamfer or bevel 21 adjoining the walkway or tread surface 20.

The pavement stone illustrated in FIG. 4 has a trapezoidal-shape cross section which is ascertained and determined by the corners 22, 23, 24, 25 and the outer imaginary boundary surfaces 26, 27, 28, 29 along a distance between these corners as well as the imaginary boundary surfaces 30, 31, 32, 33 located inwardly in a predetermined and defined spacing, preferably 8 mm. The side walls 34, 35, 36, 37 have shapes or contours which extend between the imaginary outer and inner boundary surfaces and having grooves, flutes, serrations or scores 19 continuously formed therein according to the height of the pavement stone involved therewith.

Possible variations of the inventive stone include a rectangular embodiment with a width like the side length of the quadratic stone and a length which corresponds to approximately 1½ times the width and a rectangular embodiment with a width of half the side length of the quadratic stone and a length equal to the side length of the quadratic stone.

The aforementioned fundamental or basic form of a square can be a quadratic, rectangular or trapezoidal-shaped configuration, for which respectively the same aforementioned conditions are applicable.

With an offset, shifted, displaced or staggered placement or positioning of the stones, with which one transverse joint, seam, gap or space strikes or hits upon a side wall of a stone, the corners of the two stones impinging or striking against the side wall engage in the unevenness thereof when the corners of three or four stones lie against each other, which occurs more seldomly, then in contrast to the rounded-off regions of the stones of known technology there is noted that no essential or considerable hollow spaces result between the vertical walls of the corners abutting or hitting against each other and when finally only two side surfaces of these stones engage against each other, then the mutual unevenness thereof dovetail relative to each other.

Upon start or beginning of shifting of the stones against each other as a consequence of a horizontal thrust force exerted thereon and the opposite slight turning or twisting of these stones counter thereto, the corners immediately engage in the unevenness of the adjoining side surface of the other stone and with that produce stresses that prevent a shifting or turning of the stones. In contrast thereto, with stones having rounded-off corners and arched or curved-out side surfaces there takes place a rolling-off relative to each other.

These technical advantages are attained subject to maintenance and preservation of a collective and total impression of a pavement produced with the inventive stones, which has a living individual effect and avoids the monotony of the conventional or previous concrete- or artificial pavement.

A further advantage exists in the straight forward manner and easiness to produce the tools for the pressing of the inventive stones. The irregular contours can be produced in gas or flame-cutting procedure or broaching without having to consider or pay attention to accuracy which is required for the shapes or forms of conventional stones. A bevel or chamfer on the top or upper side of the stones is producible by a simple and straight forward welding or brazing-on and if necessary by additional grinding along the press die forming-out the walkway or tread surface of the stones likewise being producible without consideration or regard for greater precision.

Since always several pressing tools or dies must be produced for a single type of the mentioned stones, each individual tool can be different in the shaping or development of the side walls of respectively the same type of stones so that during placement or positioning of the pavement there are avoided repetitions having a monotonous effect.

Most of all the resistance capability against horizontal shifting of such a pavement, for example via a truck applying brakes and/or traveling in a curve or turn can be considered as a unique advantage. The competitive stones which however have a somewhat greater format have rounded-off smooth flanks or sides so that the stones with such larger format turn or rotate against each other during horizontal thrust and can shift out of position. The stones employed according to the present invention have side or lateral indentations, teeth or serrations and with that engage in each other so that such a shifting is precluded and is no longer possible. Even though paving stones exist having geometric shapes as for example a star shape or the like which naturally engage or mesh together very well, with which however the projections are endangered by breakage, whereby during transporting as well as vertical loading such dangers exist. The corresponding indentations of the stones represent intended breakage locations. With the present inventive stones these disadvantages are avoided. In addition to the indicated structural advantage as to the danger of breakage there can be noted that furthermore the collective appearance of the visible surface of the present inventive stones during placement and positioning thereof in a formation, union or assemblage in association with each other must be recognized to be equal to that for a pavement of natural stones. Successful employment and utilization of the present inventive stones can be attributed to the unique and distinguished cooperation of features. The present inventive stones provide surface covering with unrestricted flexibility and durability as well as protection against shifting and/or displacement of the stones. The irregularly composed and restrained edges as well as the irregular joint arrangement fulfill all requirements for surface fastening capable of withstanding the loads and thrust having horizontal vectors as encountered during application of brakes and travel of vehicles during turning or in a curve.

The serrations or indentations along the sides of the stones can be referred to as grooving or rifling of which the cross sections remaining equal over the height or level thereof provide an irregular serrated and ragged or wavy-shaped contour in a depth up to 8 mm.

The present invention is, of course, in no way restricted to the specific disclosure of the specification and drawings, but also encompasses any modifications within the scope of the appended claims.

What I claim is:

1. A paving stone of concrete or artificial stone material for pavement of courtyard surfaces, pedestrian zones, garden layouts, horticultural grounds and the like, which have substantially uniform height and have in essence a four-sided-shape horizontal section with horizontal base dimensions and upright planar sides having side walls, which side walls engage relative to complementary side walls of adjoining stones during positioning of the stones into predetermined patterns collectively relative to each other, comprising:

a stone body portion having predetermined dimensions in horizontal section determined by corners of a squared surface; and said upright planar sides including an upright surface means therewith irregularly serrated in a configuration of serrations provided between locations determined by straight lines drawn between said corners in the four-sided shape horizontal section, said serrations having a depth up to 8 mm deep retreating from the upright surface means toward the stone interior.

2. A pavement stone according to claim 1 wherein said side walls are located vertically in the direct vicinity of the corners within confines of a square as formed by these corners.

3. A paving stone according to claim 2 wherein a tread surface of said paving stones has transition into said side walls via irregularities of the side walls following a chamfer along the edges.

4. A paving stone of concrete or artificial stone material for courtyards, garden layouts, horticultural grounds and the like having a substantially uniform height and including a four-sided-shape horizontal section with horizontal base dimensions and also having upright planar sides which can be placed together to engage relative to complementary side walls of adjoining stones put into patterns during positioning and placement of the stones collectively relative to each other, comprising:

a stone body in the predetermined measurements thereof in horizontal section being determined by corners of a rectangular surface in a horizontal section, and said upright planar sides have side walls which extend between said corners along the path defined by straight lines drawn in the four-sided-shape horizontal section and also including uneven groove contours up to 8 mm deep retreating to the stone interior along the upright side walls.

5. A pavement stone according to claim 4 wherein said side walls are located vertically in the direct vicinity of the corners within confines of a square as formed by these corners.

6. A paving stone according to claim 5 wherein a tread surface of said paving stones has transition into said side walls via irregularities of the side walls following a chamfer along the edges.

7. A paving stone of concrete or artificial stone material for pavement of courtyards, garden layouts, horticultural grounds, walkway pavement as well as tread surface of roadways and the like which have a substantially uniform height and including a four-sided-shape horizontal section with horizontal base dimensions and also having upright side walls which can be placed together to engage relative to complementary side walls of adjoining stones put into patterns during positioning of the stones collectively relative to each other, comprising:

irregular groove-ridge means up to 8 mm deep in the side walls and retreating toward the stone interior, said irregular groove-ridge means adjoining stones engaging relative to each other to prevent shifting of said stones under loading including application of brakes of a vehicle as well as during travel of such vehicle when turning or in a curve.

8. A pavement stone according to claim 7 wherein said side walls are located vertically in the direct vicinity of the corners within confines of a square as formed by these corners.

9. A paving stone according to claim 7 wherein a tread surface of said paving stones has transition into said side walls via irregularities of the side walls following a chamfer along the edges.

10. A paving stone according to claim 7 wherein tread surfacing of the stone has substantially 45° chamfering all around at least the upper edges thereof.

11. A paving stone according to claim 7 wherein a tread surface thereof has a beveled chamfer all around the body of such stone; and irregular fluted grooves of variable form and shape extend through upright sidewalls into the beveled chamfer.

12. A paving stone according to claim 11 in which the tread surface has a trapezoidal shaped cross section and said grooved flutes are jagged to engage and lock with respect to adjoining stones for strength and rigidity in a pavement having mechanical strength against shifting dislocation and damage due to horizontal thrust stopped from causing any displacement or shifting of the stones due to the grooved flutes scored into said sidewalls as jagged abutments to stop any movement of stones relative to each other.

* * * * *